US009260231B2

(12) United States Patent
Havrileck et al.

(10) Patent No.: US 9,260,231 B2
(45) Date of Patent: Feb. 16, 2016

(54) NON-RESEALABLE THERMOFORMED PACKAGING FOR LIQUID OR PASTY SUBSTANCES

(75) Inventors: Bertrand Havrileck, Nice (FR); Michel Robin, Antibes Juan les Pins (FR)

(73) Assignee: VIRBAC SA, Carros (FR)

( * ) Notice: Subject to any disclaimer, the term of this patent is extended or adjusted under 35 U.S.C. 154(b) by 0 days.

(21) Appl. No.: 13/321,302

(22) PCT Filed: May 20, 2010

(86) PCT No.: PCT/FR2010/000384

§ 371 (c)(1),
(2), (4) Date: Jan. 30, 2012

(87) PCT Pub. No.: WO2010/133778

PCT Pub. Date: Nov. 25, 2010

(65) Prior Publication Data

US 2012/0118920 A1 May 17, 2012

(30) Foreign Application Priority Data

May 20, 2009 (FR) ..... 09 02478

(51) Int. Cl.
*B65D 47/10* (2006.01)
*B65D 75/32* (2006.01)
*B65D 75/58* (2006.01)

(52) U.S. Cl.
CPC ..... *B65D 75/325* (2013.01); *B65D 75/5811* (2013.01); *B65D 2215/00* (2013.01)

(58) Field of Classification Search
CPC ..... B65D 75/48; B65D 75/5805; B65D 75/5811; B65D 75/5816; B65D 75/5822; B65D 75/5866; B65D 75/36; B65D 75/325; B65D 47/2031; B65D 1/095; B65D 2575/586
USPC ..... 222/153.05–153.07, 491, 494, 212, 222/541.6, 541.9; 215/250; 220/266; 426/115, 122
See application file for complete search history.

(56) References Cited

U.S. PATENT DOCUMENTS 1,907,939 A * 5/1933 Venning et al. ..... 229/215
2,546,709 A * 3/1951 Abarr ..... 222/213
(Continued)

FOREIGN PATENT DOCUMENTS

DE 202004000591 U1 4/2004
DE 202004003781 U1 5/2004
(Continued)

OTHER PUBLICATIONS

DEU202004000591MT, machine traslation of DE 202004000591.*
(Continued)

*Primary Examiner* — Patrick M Buechner
*Assistant Examiner* — Randall Gruby
(74) *Attorney, Agent, or Firm* — Westerman, Hattori, Daniels & Adrian, LLP

(57) ABSTRACT

The invention relates to a packaging comprising: a rigid shell that can be deformed by having a user apply pressure, said shell forming a storage space (1) containing a liquid or pasty substance; a breakage area (6) for releasing an applicator (3) for ejecting the liquid or pasty substance from said packaging; and a gripping area (5) including an escape path (7) for said liquid or pasty substance, the escape path being naturally closed when the user applies no pressure such that the liquid or pasty substance is prevented from being discharged after opening the packaging.

22 Claims, 13 Drawing Sheets

(56) References Cited

U.S. PATENT DOCUMENTS

| | | | | | |
|---|---|---|---|---|---|
| 2,628,761 | A * | 2/1953 | Yancey | 229/125.12 |
| RE24,251 | E * | 12/1956 | Kaplan | 222/107 |
| 2,776,787 | A * | 1/1957 | Nicol | 222/544 |
| 2,962,192 | A * | 11/1960 | Volckening | 222/107 |
| 3,072,248 | A * | 1/1963 | Bishop | 383/209 |
| 3,127,063 | A * | 3/1964 | Fairchildd | 222/153.06 |
| 3,184,121 | A * | 5/1965 | Volckening | 222/213 |
| 3,241,726 | A * | 3/1966 | Chester | 222/211 |
| 3,250,436 | A * | 5/1966 | Kurtz | 222/153.07 |
| 3,278,085 | A * | 10/1966 | Brown | 222/107 |
| 3,556,292 | A * | 1/1971 | Krzyzanowski | 206/464 |
| 3,721,360 | A * | 3/1973 | Collie | 215/49 |
| 3,913,734 | A * | 10/1975 | Siegel | 206/470 |
| 4,168,002 | A * | 9/1979 | Crosby | 206/459.5 |
| 4,209,096 | A * | 6/1980 | Carkhuff | 206/469 |
| 4,252,257 | A * | 2/1981 | Herzig | 222/213 |
| 4,356,935 | A * | 11/1982 | Kamin | 222/1 |
| 4,491,245 | A * | 1/1985 | Jamison | 222/107 |
| 4,545,844 | A * | 10/1985 | Buchanan | 156/515 |
| 4,792,060 | A * | 12/1988 | Brogli | 222/107 |
| 4,917,267 | A * | 4/1990 | Laverdure | 222/107 |
| 4,988,016 | A * | 1/1991 | Hawkins et al. | 222/92 |
| 5,000,350 | A * | 3/1991 | Thomsen | 222/103 |
| 5,038,974 | A * | 8/1991 | DaCosta | 222/106 |
| 5,067,635 | A | 11/1991 | Thomsen | |
| 5,154,293 | A * | 10/1992 | Gould | 206/461 |
| 5,203,459 | A * | 4/1993 | Wade | 206/572 |
| 5,529,224 | A * | 6/1996 | Chan et al. | 222/212 |
| 5,727,687 | A | 3/1998 | Renner | |
| 5,839,609 | A * | 11/1998 | Zakensberg | 222/107 |
| 5,996,845 | A * | 12/1999 | Chan | 222/107 |
| 6,094,886 | A * | 8/2000 | Poignant | 53/412 |
| 6,357,631 | B1 * | 3/2002 | Zaksenberg | 222/212 |
| 6,932,241 | B2 * | 8/2005 | Hagihara | 222/92 |
| 7,004,322 | B1 * | 2/2006 | Bartoli | 206/484 |
| 7,004,354 | B2 * | 2/2006 | Harper | 222/94 |
| D525,144 | S * | 7/2006 | Risgalla | D9/707 |
| 7,607,834 | B2 * | 10/2009 | Alvater et al. | 383/210 |
| D634,643 | S * | 3/2011 | Caldwell et al. | D9/707 |
| 8,061,563 | B1 * | 11/2011 | Rosen | 222/107 |
| D663,414 | S * | 7/2012 | Robin | D24/115 |
| 8,307,983 | B2 * | 11/2012 | Ludwig et al. | 206/532 |
| 8,430,266 | B2 * | 4/2013 | Barton | 220/694 |
| 2003/0230604 | A1 | 12/2003 | Huffer | |
| 2004/0129721 | A1 | 7/2004 | Bianchini et al. | |
| 2004/0197504 | A1 * | 10/2004 | Finestone et al. | 428/35.2 |
| 2005/0226767 | A1 | 10/2005 | Klocke | |
| 2006/0229583 | A1 | 10/2006 | Nagao et al. | |
| 2006/0237477 | A1 * | 10/2006 | Gregg | 222/94 |
| 2006/0278562 | A1 * | 12/2006 | Van Puijenbroek | 206/581 |
| 2007/0045341 | A1 * | 3/2007 | Bauer | 222/107 |
| 2007/0119862 | A1 * | 5/2007 | Backes et al. | 222/94 |
| 2007/0228073 | A1 | 10/2007 | Mazzarino | |
| 2008/0029411 | A1 * | 2/2008 | Polloni et al. | 206/268 |
| 2008/0190809 | A1 | 8/2008 | Simon et al. | |
| 2009/0001092 | A1 * | 1/2009 | Jenkins | 220/796 |
| 2012/0223099 | A1 * | 9/2012 | Sanchez | 222/103 |
| 2013/0001123 | A1 * | 1/2013 | Greenland | 206/462 |
| 2013/0084367 | A1 * | 4/2013 | Caldwell et al. | 426/122 |
| 2013/0119103 | A1 * | 5/2013 | Mango | 224/483 |
| 2013/0161326 | A1 * | 6/2013 | Van Puijenbroek | 220/270 |
| 2013/0341350 | A1 * | 12/2013 | Montarras et al. | 222/92 |

FOREIGN PATENT DOCUMENTS

| | | | |
|---|---|---|---|
| EP | 0150751 | A1 | 8/1985 |
| EP | 0930238 | A1 | 7/1999 |
| EP | 1133969 | A1 | 9/2001 |
| FR | 2742733 | A1 | 6/1997 |
| JP | 47-11824 | | 5/1972 |
| JP | 52-38550 | | 9/1977 |
| JP | 2008-514516 | A | 5/2008 |
| WO | 83/01052 | A1 | 3/1983 |
| WO | 01/19448 | A1 | 3/2001 |
| WO | 02/070352 | A2 | 9/2002 |
| WO | 2004/030821 | A1 | 4/2004 |
| WO | 2006/058139 | A2 | 6/2006 |
| WO | 2006/085063 | A1 | 8/2006 |
| WO | 2008/086389 | A2 | 7/2008 |
| WO | 2010/084392 | A1 | 7/2010 |

OTHER PUBLICATIONS

International Search Report of PCT/FR2010/000384, mailing date Oct. 27, 2010.

Office Action from Japanese Patent Office dated Dec. 3, 2013 in counterpart JP application No. 2012-511316; with English translation.

* cited by examiner

NON-RESEALABLE THERMOFORMED PACKAGING FOR LIQUID OR PASTY SUBSTANCES

FIELD OF THE INVENTION

The present invention relates to a non-resealable thermoformed packaging for a safety product, in particular with respect to children, for foodstuffs, cosmetics, pharmaceuticals, or veterinary products, for the purposes of homogeneously and atraumatically delivering a liquid or pasty substance to the application site of a subject to be treated or fed.

BACKGROUND OF THE INVENTION

Children, by nature, are curious and in search of learning experiences. The discovery of new objects can thus be highly dangerous, if these children are not under the supervision of an adult. Indeed, the discovery of new objects, in particular by young infants, leads to grasping, but also to sucking or biting.

Thus, products or packaging items which are intended to contain active or toxic substances and which in particular require the reference "child resistant", in other words safety products or packaging items for children, must not be easily openable by children below the age of 5 years. However, the difficulty for children in opening such packaging items must not cause the system to be too complex, nor said opening to be achieved at the expense of the convenience of its use for the user, in particular by elderly persons.

Currently existing safety packaging items for children, designed for the homogeneous delivery of a liquid or pasty substance, are often neither practical to use, nor adapted to the product or the packaged contents.

Different technical solutions have already been implemented. Known examples include child-proof container stopper devices, including a neck having on its external surface two axially offset threads and a stopper having on its internal surface two axially offset threads which respectively match the threads on the external surface of the container, with the separation between the stopper threads being smaller than the separation between the neck threads, thus making it necessary to combine several movements in order to open the container. The areas included in between the respective threads of the neck and the stopper are furthermore provided with ring-shaped grooves which make it necessary to pull strongly on the stopper in order to open the container. Other solutions, in particular as shown in utility model DE202004003781U in the name of Klocke Verpackungs-Service GmbH, involve making the packaging safe for children, in particular by means of isolation in an additional overwrap. Thus, it is this over-wrapped packaging which is referred to as being "child resistant".

Nevertheless, these solutions are not always entirely satisfactory. Indeed, such stoppers or over-wrapped packaging items are not environmentally or economically attractive. Furthermore, their manipulation, and in particular the difficulty in opening the overwrap, make their use sometimes difficult and unpractical.

In the field of veterinary pharmacy, with topical product delivery systems for the fur of animals, for example dogs and cats, the packaging can also have other drawbacks, in particular for the user and/or the subject to be fed or treated. Thus, once they have been opened, existing packaging items, such as for example the packaging for the FRONTLINE™ Spot on Chien (Fipronil 10% plv) product marketed by the Merial™ company, or the packaging items described in WO2004/030821, once having been opened, allow uncontrolled outpouring of their contents, if the user does not take care or drops the packaging.

Indeed, the presence of a pharmaceutical product dispensing system with a thermoformed nozzle makes it possible for the substance to flow by mere gravity, once the packaging has been opened. This causes the manipulation of the above-mentioned products to increase the risk of accidental contamination of the user, the subject to be treated, or the environment. Moreover, it can happen that some of the product present in the nozzle escapes without control when it is opened. This can lead to significant compliance problems (i.e. in respecting the prescribed dosage) when pharmaceutical or veterinary products are concerned, since the user no longer knows exactly what dose he will deliver. In addition, thermoformed nozzles are rigid and can have undesirable cracks, depending on their length and the nature of the materials from which they are made. It can thus happen that they break upstream the breakage line, increasing the risk of a loss of product and contamination of the user's fingers.

SUMMARY OF THE INVENTION

Thus, a first object set out by the applicant, is to provide a non-resealable packaging which ensures safety, in particular for children, is practical to use once it has been opened, is leak-resistant, and allows its contents, i.e. a liquid or pasty substance, to flow out homogeneously, only under the control of the user.

A further drawback of currently marketed packaging items, which represent the technical state-of-the-art of the invention, is related to their opening system. Indeed, after being opened, during application at the site to be treated or fed of a subject, some types of rigid packaging can produce small scratches, for example on the skin or mucosa, due to the presence of sharp edges which appear close to the applicator during opening of the packaging.

A further object set out by the applicant is thus to provide a packaging which is atraumatic, i.e. which, even if sharp edges are present, avoids scratching or injuring by the applicator, of the administration site on the subject to be treated or fed.

Finally, the packaging according to the invention must be adapted to the contents which it accommodates.

Indeed, the stability of the contents depends partly on the nature and integrity of the material from which the packaging is made. The latter can influence interactions with the contents, as well as exchanges with the exterior such as the leakage of water or even oxygen. De facto, in cases where there are areas of weakness in the vicinity of the opening or breakage area on the packaging, the integrity of the packaging material is not always homogeneous since the area of weakness corresponds to a physical fragility of the shell, which facilitates opening, but also reduces the quality of packaging protection. The stability of the contents also depends both on the dead volume, which determines the quantity of air in contact with the contents; and also on the transparency, which affects any possible photo-degradation effects.

A further object set out by the applicant is thus to provide a packaging which is adapted to its contents.

In view of the above, a problem to be solved by the object of the present invention is to provide a packaging which is safe, practical to use, adapted to its contents and economically and environmentally advantageous, as well as a method for preparing such packaging, and which does not have all or part of the previously mentioned drawbacks.

A first object of the solution proposed by the invention to remedy this problem is to provide a non-resealable thermoformed packaging for delivering a liquid or pasty substance, said packaging comprising:

a rigid shell that can be deformed by means of pressure applied by a user, said shell forming a storage space, said storage space containing said liquid or pasty substance;

a breakage area for releasing an applicator in order to eject the liquid or pasty substance from said packaging; and a gripping area including an escape path for said liquid or pasty substance, the escape path being naturally closed, i.e. normally preventing said liquid or pasty substance from being discharged, in the absence of pressure applied by the user in order to block the discharge of said liquid or pasty substance after opening the packaging.

By thermoformed packaging is understood packaging which has been manufactured by thermoforming a bottom complex, by thereto-sealing or gluing a sealing complex and cutting in order to obtain the final shape.

The escape path is generally formed by an unsealed, narrow contact area, between the bottom complex and the sealing complex bounded by the edges of the escape path, by thermosealing or gluing the bottom complex to the sealing complex. The escape path enables discharge of the liquid or pasty substance when pressure applied by the user on the deformable rigid storage space is propagated to the escape path and causes a deformation that leads to the disappearance of the close contact between the bottom complex and the sealing complex, which was the cause of the escape path's closure.

A second object is to provide a food, cosmetic, pharmaceutical or veterinary composition, contained in a packaging according to that described above.

Finally, a third object is to provide a package which combines at least two safety packaging items such as described above, containing different or identical compositions and a user manual specifying whether or not said compositions are to be used together, or at regular intervals.

BRIEF DESCRIPTION OF THE DRAWINGS

Other purposes, advantages and features of the invention will become more apparent from the following non-limiting description and preferred embodiments of the object and scope of the present patent application, with reference to the accompanying figures, in which.

DETAILED DESCRIPTION OF PARTICULAR EMBODIMENTS

Figure 1:
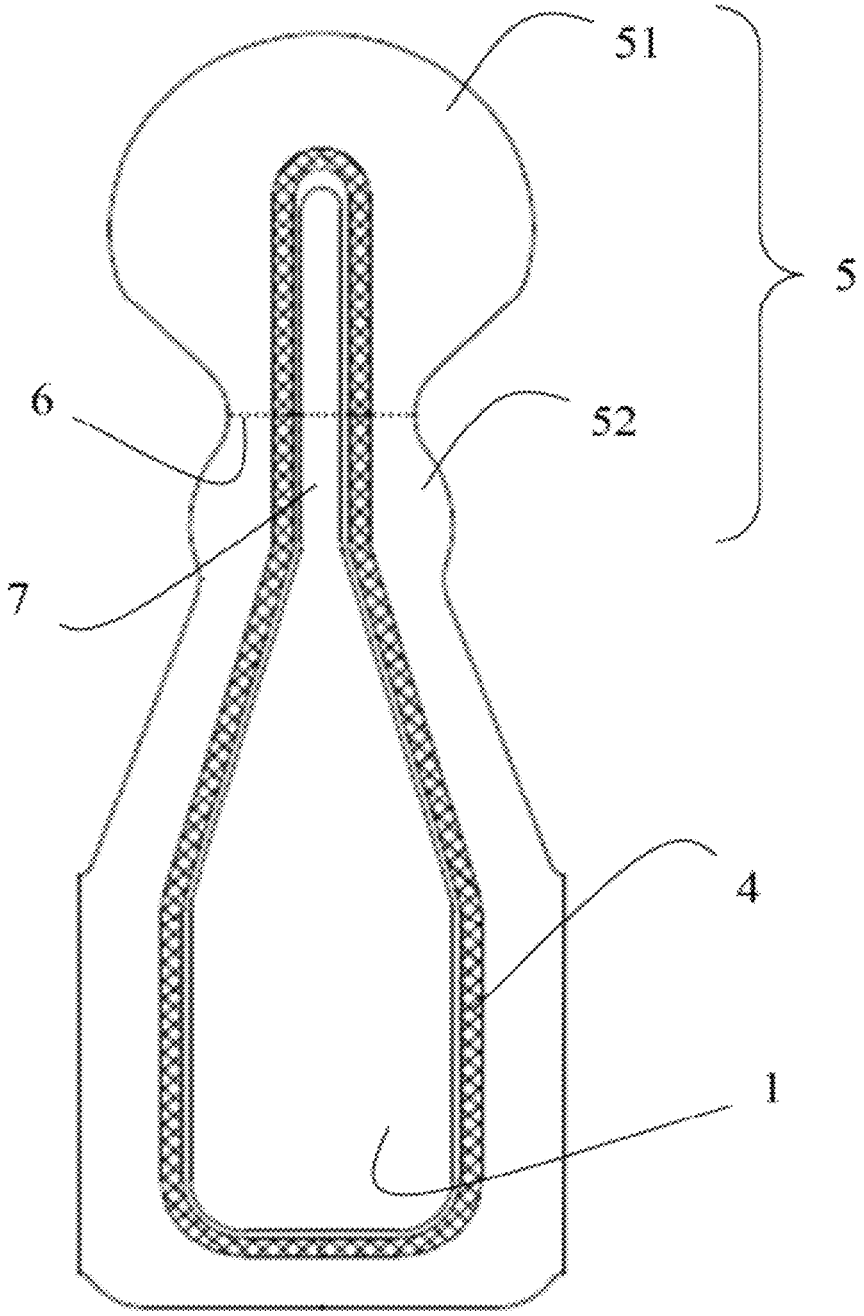
FIGS. 1, 2 and 3 show, in a schematic view, different embodiments of closed packaging items according to the invention, viewed from above (where the visible side corresponds to the sealing complex)
Figure 2:
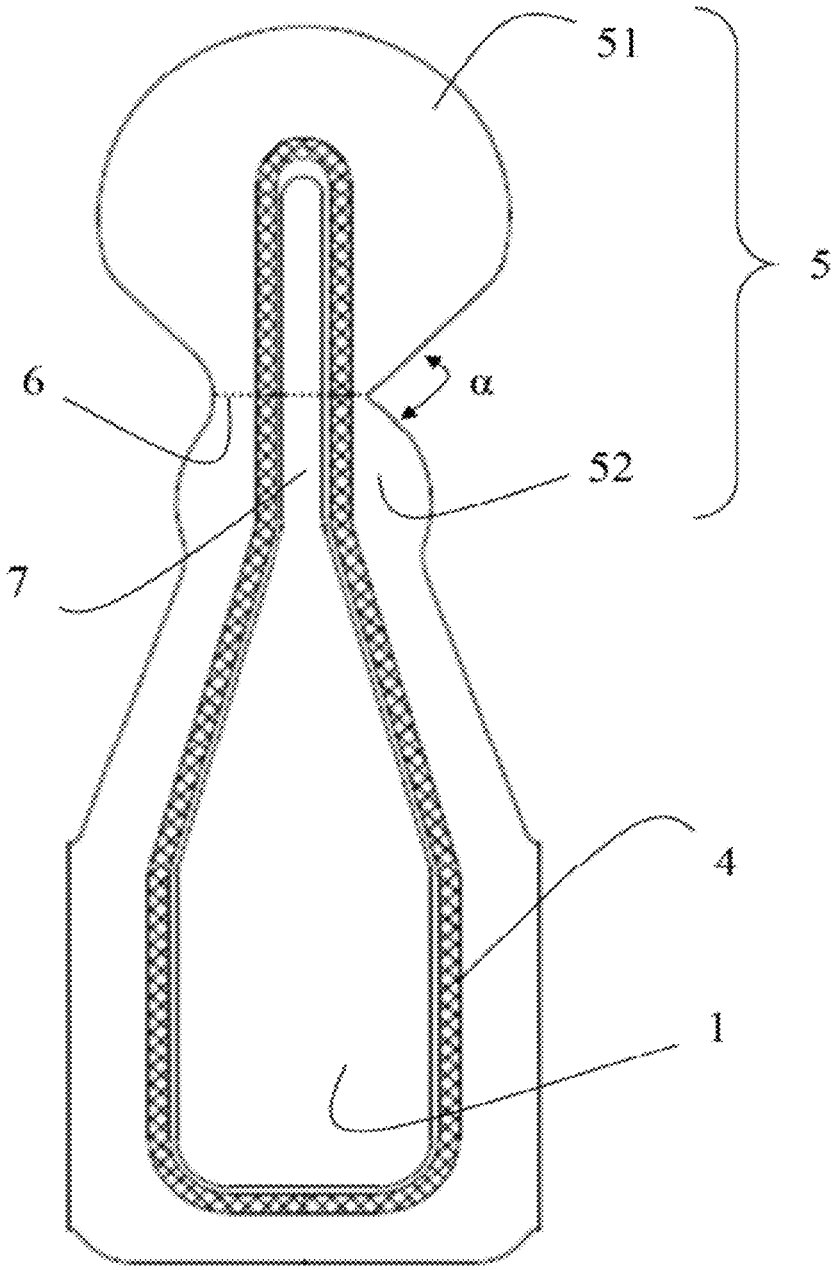
Figure 3:
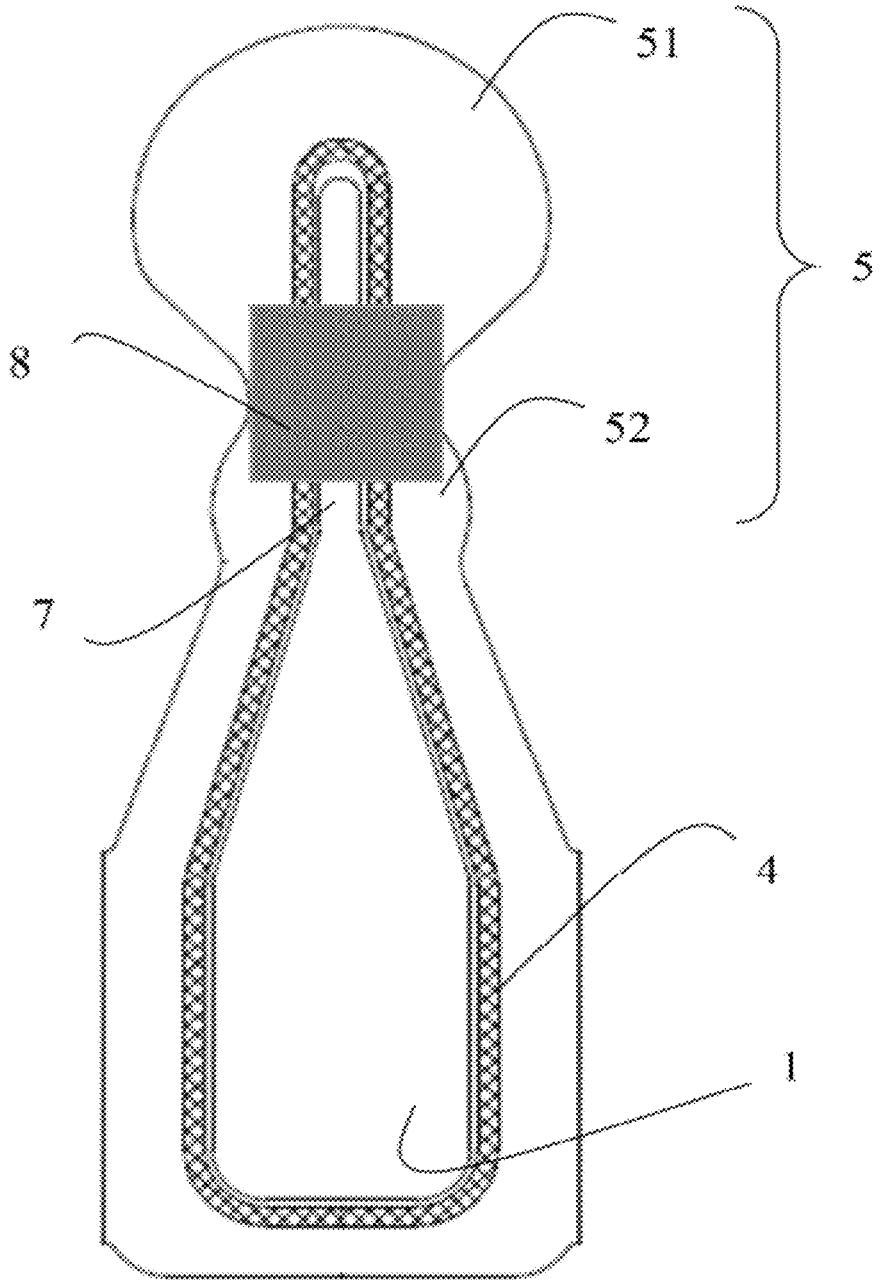
Figure 4:
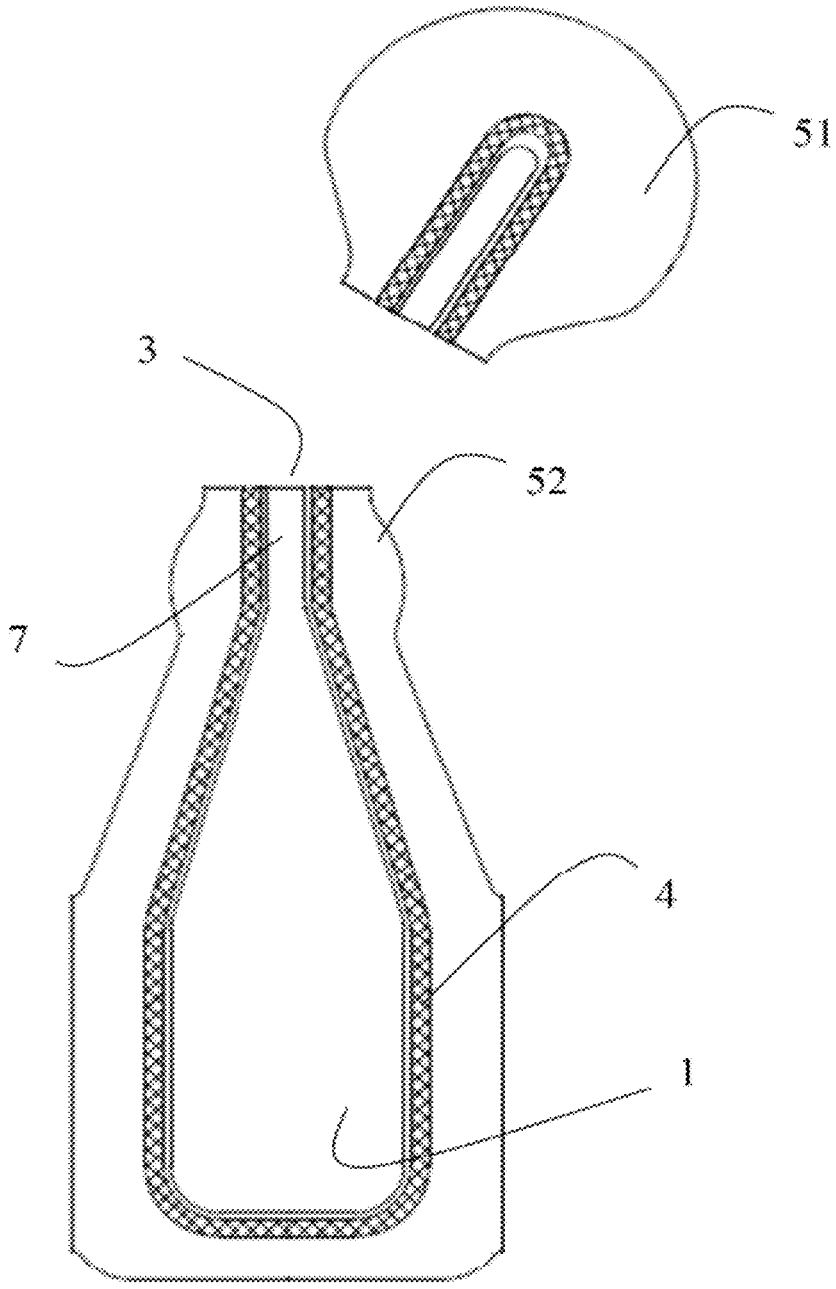
FIGS. 4 and 5 show, in a schematic view, an open packaging according to the invention, viewed from above (where the visible side corresponds to the sealing complex)

FIGS. 1, 2, 3, 4 and 5 show three possible alternative packaging embodiments according to the invention, said packaging being opened (FIGS. 4 and 5) or closed (FIGS. 1, 2 and 3). The lower portion of the packaging comprises, in its central part, a shell forming the storage space 1, which accommodates contents in a liquid or pasty form.

The upper portion of the packaging comprises an escape path 7 between the upper end portion of the storage space 1 and the applicator 3, which is removed when the packaging is opened and is being used. This escape path 7, allowing the flow of the liquid or pasty substance from the storage space towards the applicator, is naturally closed in the absence of pressure being applied to the storage space 1.

Figures 7A, 7B:
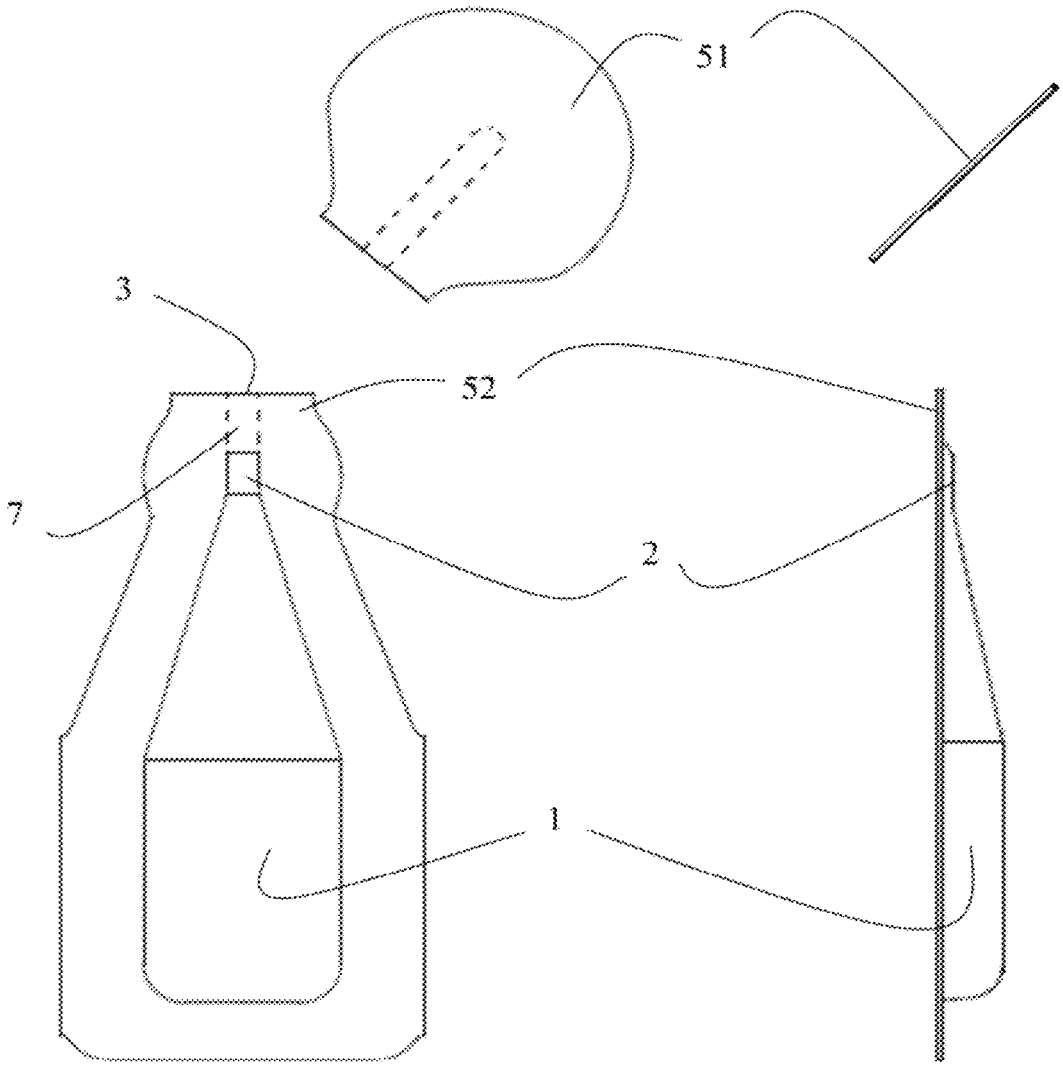
FIG. 7*a* represents, in a schematic view, an open packaging according to the invention, viewed from below (where the visible side corresponds to the bottom complex, i.e. the protruding storage space)
FIG. 7*b* shows, in a schematic view, a side view of an open packaging according to the invention.

According to a first alternative embodiment, the storage space 1 has, in its upper end portion, a rigid protrusion 2 (FIGS. 7*a* and 7*b*). This rigid protrusion 2 is intended to concentrate the arrival of the liquid or pasty substance at the escape path 7.

Preferably, the upper portion of the packaging comprises a gripping area 5 formed from two gripping lugs 51 and 52. The upper portion of said gripping area 5, that is, the gripping lug 51 can be torn in a breakage area 6 and thus release the applicator 3. Thanks to the presence of said gripping lugs 51 and 52, there is an extremely reduced, if not nil, risk of unintentionally pressing the storage space 1 and causing the leakage of the product during the opening operation.

Those skilled in the art will be able to adapt the shape and size of the two gripping lugs 51 and 52 of the gripping area 5 as long as they remain well adapted to being held by the user and allow the breakage area 6 to be broken in order to release the applicator 3.

According to one advantageous embodiment of the invention, the breakage area 6 can be broken by means of a back and forth movement of the upper gripping lug 51. For this purpose, the user must maintain the pipette in the lower gripping area 52. Alternatively, the breakage area can be torn by means of a pivoting movement for which the user grasps the gripping lug 51 with one hand, preferably between the thumb and the index finger. The user applies his other hand to the gripping lug 52 in the same manner, and tears the breakage area 6 in order to release the applicator 3. In all opening modes, the position of the hands on the gripping lugs, in particular gripping lug 52, applies a compressive force to the escape path 7, which prevents the accidental release of the liquid or pasty substance present in the storage space 1.

Figures 6A, 6B:
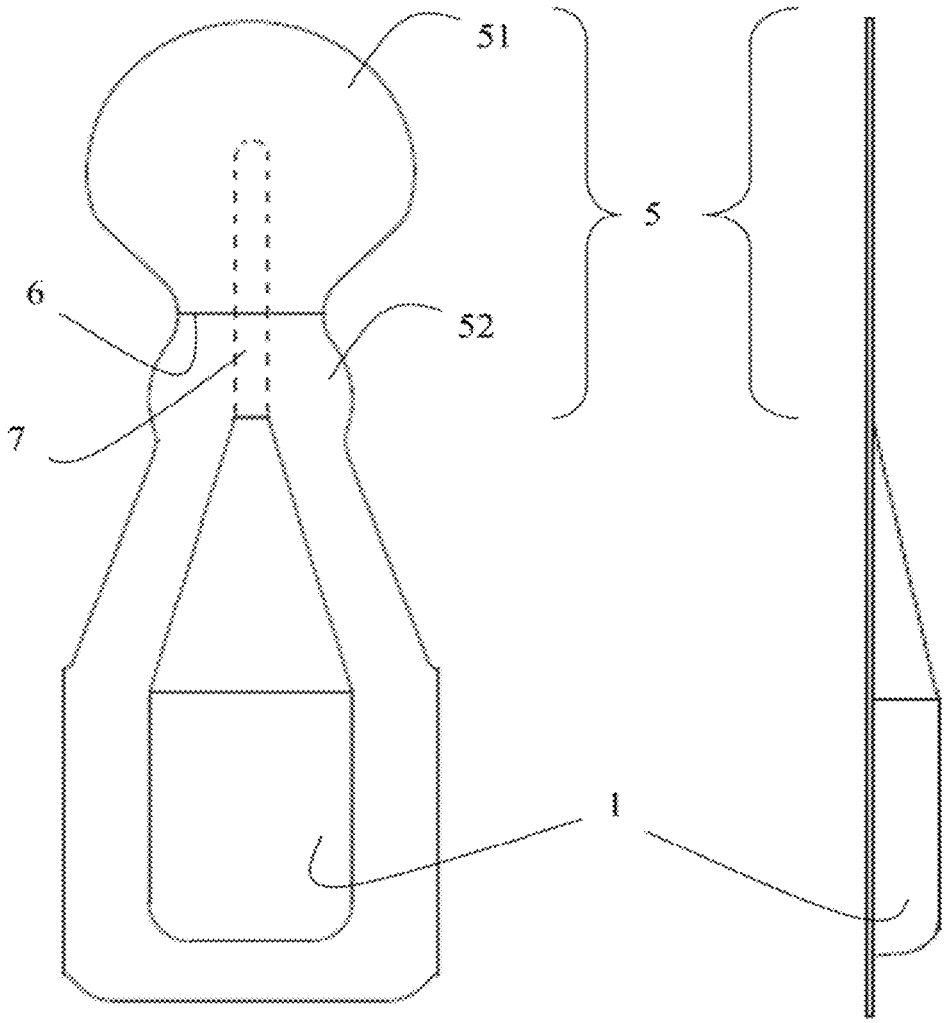
FIG. 6*a* shows, in a schematic view, a closed packaging item according to the invention, viewed from below (where the visible side corresponds to the bottom complex, i.e. the protruding storage space 1)
FIG. 6*b* shows, in a schematic view, a side view of the closed packaging according to the invention.

As is shown in FIGS. 6*a* and 7*a*, which are bottom views of an open (FIG. 7*a*) or closed (FIG. 6*a*) packaging according to the invention, the bottom portion of the packaging, which is substantially flat, also comprises in its central portion, the storage space 1 which forms a deformable and rigid shell that accommodates the contents in a liquid or pasty form. This storage space 1 is connected to the top portion of the packaging through the escape path 7, which is naturally closed when no pressure is applied to the storage space 1.

Alternatively, the pealable label 8 is positioned on the breakage area 6 (see FIG. 3). When in place, the pealable label 8 significantly strengthens the structure of the breakage area. The user must then remove the pealable label 8 before tearing or breaking the gripping area 5 in the breakage area 6. This pealable label 8 enhances the safety of the packaging, particularly with respect to children, due to the fact that the added manipulation creates a sequence of additional actions needed to open the packaging.

Also, the breakage area 6 can alternatively consist of a connection area between the gripping lugs 51 and 52 of smaller thickness and/or width, which forms an easily breakable or tearable weakness area. Such a weakness area may consist of a breakage line within the thickness of the material forming the bottom complex. The breakage line or groove is conventionally made using a pre-cutting tool such as a blade, a laser system or a high-pressure water jet. Preferably, in order to restrict the presence of sharp edges, which may cause scratches at the location where the product is applied, the breakage line has a convex shape. Generally, the shape of the applicator will be determined by the shape of the breakage line.

One advantage provided by the escape path in the case where the breakage area comprises a breakage line is that the product does not come into contact with this weakened area. This is because the escape path is normally closed along its entire length so that no pressure is applied to the storage space 1. This contributes to provide appropriate stability to the contents.

In the event that the weakness area is at least partially formed by a narrowing between lugs 51 and 52, further weakening can be achieved by forming corners whose vertices define the breakage area, with the angles $\alpha$ thus formed being the same or different and preferably smaller than 120°, and even more preferably, smaller than 90° (see FIG. 2).

It is also recommended that a pair of scissors be used to cut the breakage area by simultaneously holding lug 52.

The outer portion of the packaging, i.e. the outer portion of storage space 1 and escape path 7, includes a sealed area 4. Preferably, the sealing of area 4 is performed by gluing, heat-welding, diamond point welding or also downhand welding. The width of this sealed area 4 may extend up to the edge of the packaging.

Figure 8:
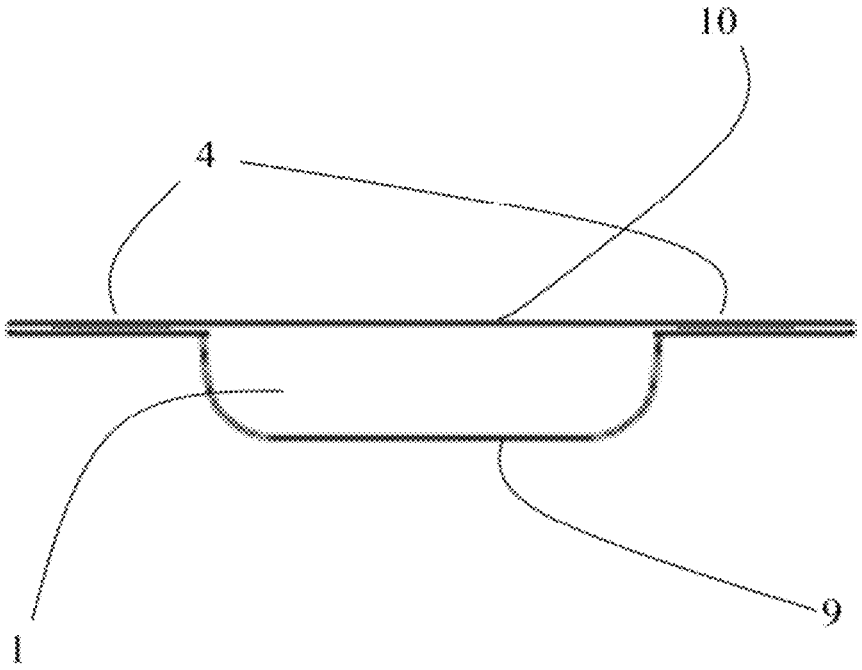
FIG. 8 shows, in a schematic view, a cross-sectional view of the packaging storage space according to the invention.

As shown in FIG. 8, the packaging according to this invention is formed of at least two different materials. In particular, the bottom portion where the storage space 1 is protruding, also referred to as the bottom complex 9, is preferably formed of a thermoformable rigid film. The flat top portion, which consists of the sealing complex 10 is, in turn, preferably formed of a flexible film. According to the invention, the assembly of the packaging is preferably achieved by heat-welding of said portions in area 4. The contours, size and shape of the storage space 1 and the escape path 7 are determined by the sealed area 4.

The escape path 7 is opened by the deformation of the bottom complex and/or sealing complex when the liquid or pasty substance contained in the container passes through it, under the action of the pressure applied by the user to the storage space.

Figures 12A, 12B:
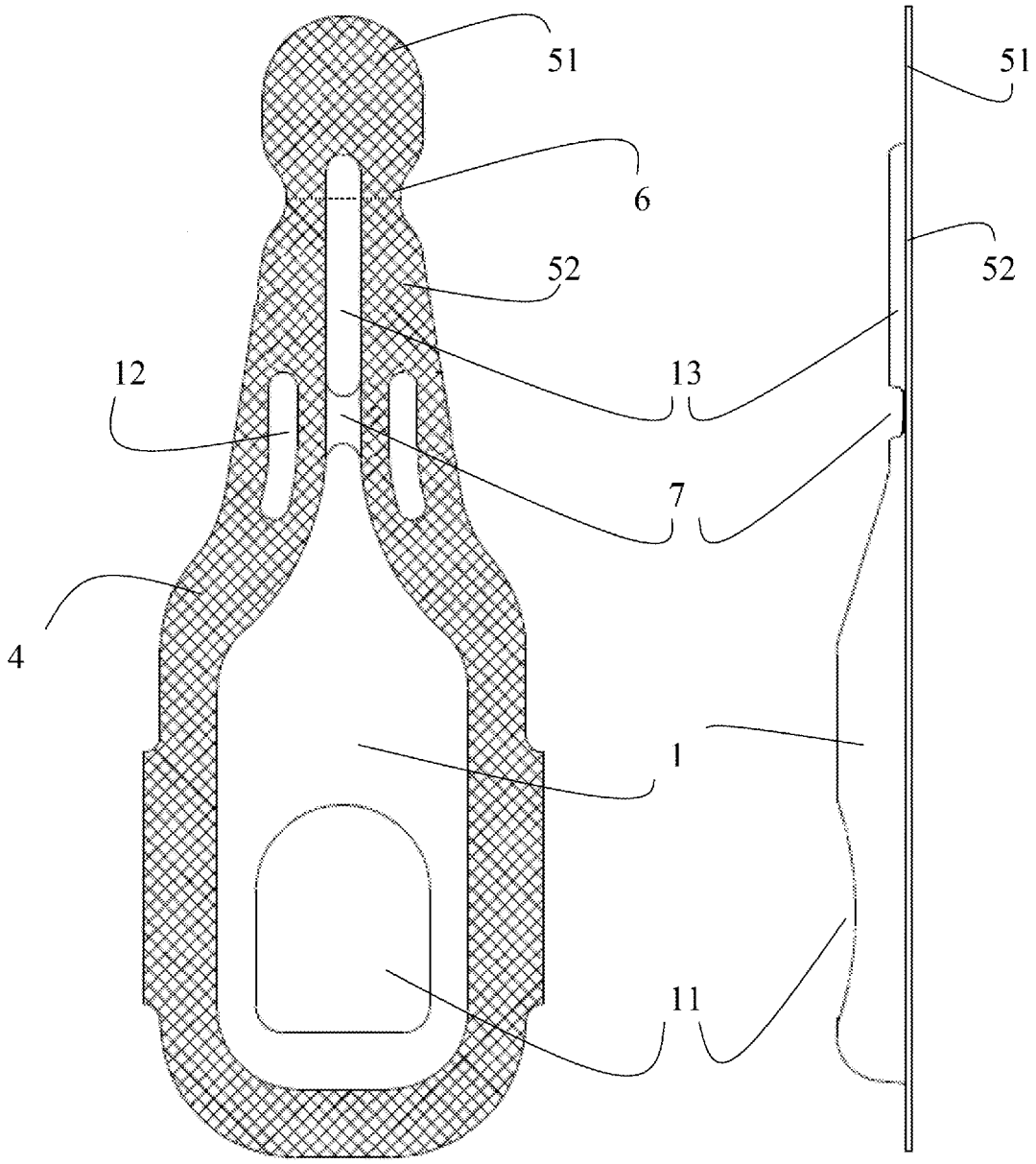
FIG. 12A represents, in a schematic view, an alternative packaging embodiment according to the invention, viewed from below (where the visible side corresponds to the bottom complex, i.e. the protruding storage space 1)
FIG. 12B shows, in a schematic view, a longitudinal cross-section of the packaging shown in FIG. 12A, viewed from the side.

According to one embodiment of the invention shown in FIGS. 12A and 12B, the escape path may be integrated into a thermoformed conduit 13 to assist the passage of the liquid or pasty substance between the storage space 1 and the applicator 3. The conduit thus formed, which is otherwise naturally open as shown on FIG. 12B, will be naturally closed by the single, continuous escape path 7 in the absence of pressure applied by the user to the storage space.

Figures 13A, 13B:
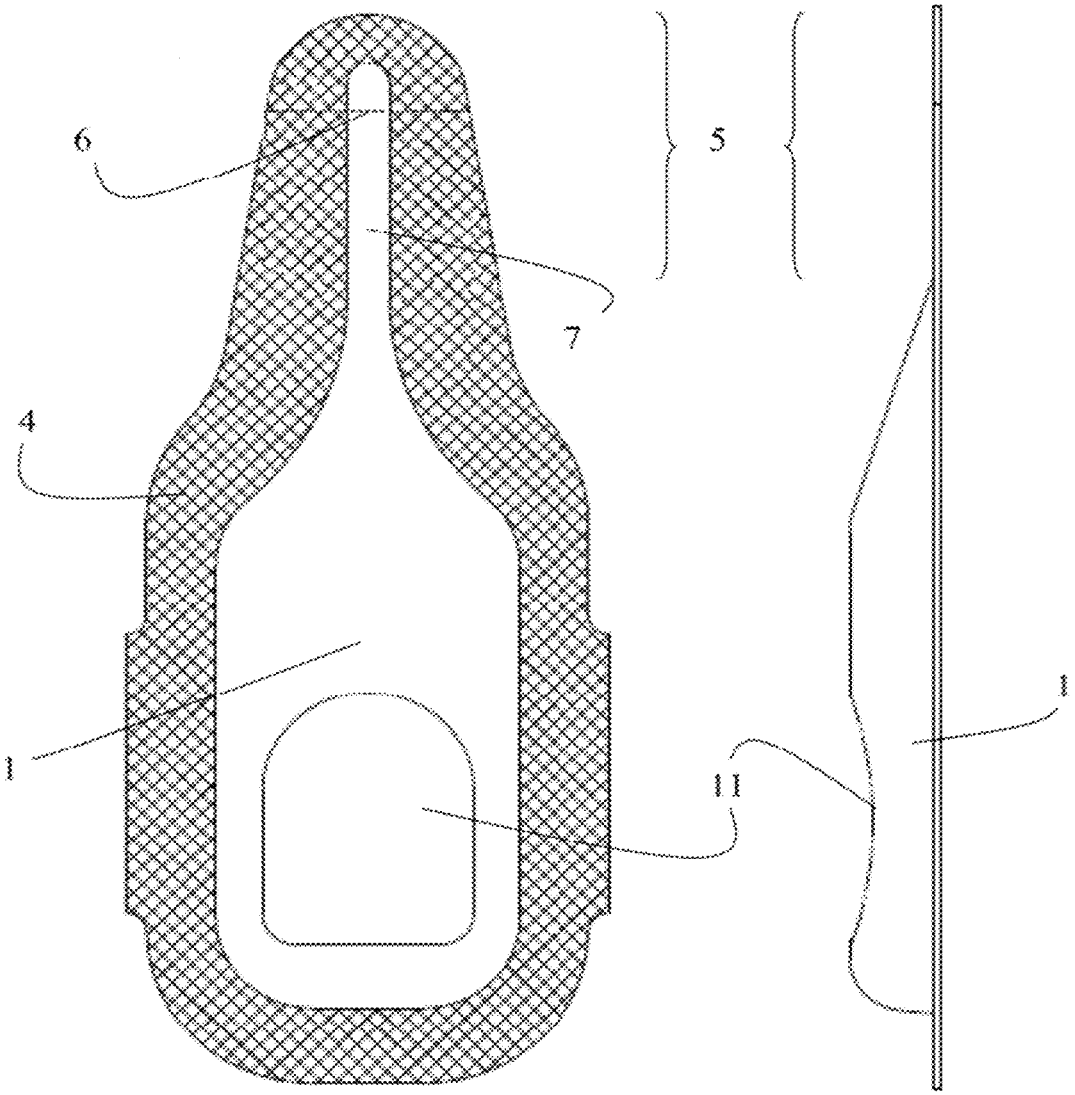
FIG. 13A shows, in a schematic view, an alternative packaging embodiment according to the invention, viewed from below (where the visible side corresponds to the bottom complex, i.e. the protruding storage space 1)
FIG. 13B shows, in a schematic view, a longitudinal cross-section of the packaging shown in FIG. 13A, viewed from the side.

Advantageously, as illustrated in FIGS. 12A and 13A, the bottom complex has a recess 11 which substantially has the shape of a finger tip. The user can position his thumb, for example, in the recess 11, to press the shell near to the storage space and thus control the discharge of the liquid or pasty substance.

To improve the rigidity of the upper portion of the packaging, reinforcements 12 may be arranged on either side and close to the escape path 7, i.e., not extending to the applicator, as shown in FIG. 12A.

Advantageously, the rigid film is formed from a material selected from polypropylene (PP), polyvinyl chloride (PVC), polyvinylidene chloride, a cyclo-olefin copolymer (COC), polychlorotrifluoro ethylene (PCTFE), or derivatives thereof, alone or in admixture.

More preferably, the rigid film is Polybar™, sold by Alcan Packaging™, which consists of a cyclo-olefin copolymer (COC) film coextruded between two polypropylene (PP) layers. The Polybar is then glued or laminated to a film of Barex™. These as a whole form the bottom complex.

A feature of the rigid film is that it must form a deformable shell near to the storage space 1, that is, it must be able to deform under the action of the pressure applied by the user to drive out the liquid or pasty product from the storage space 1 towards the applicator 3 through the escape path 7. The shape of the storage space 1 should ideally allow the storage space to be entirely emptied under the action of the pressure applied by the user.

Advantageously, the flexible film comprises a material selected from polyethylene terephthalate (PET), polyamide, aluminum or polyacrylonitrile marketed by BP Chemicals™ under the brand name Barex™, or derivatives thereof, alone or in admixture.

The present invention also relates to a method for manufacturing a packaging which is safe, in particular for children. This method comprises a step of sealing a thermoformed rigid portion and a flexible portion, as described above, comprising a storage space 1 and an escape path 7 towards an applicator 3.

The storage space 1 of the packaging according to the invention comprises a liquid or pasty composition liable to be discharged through the escape path 7 up to the applicator 3 after the breakage area has been opened by a user applying sufficient pressure to the storage space 1. The liquid or pasty composition may have applications in many fields, including the food, cosmetic, pharmaceutical and veterinary fields. It may therefore be a foodstuff (food-grade liquid or paste) intended to be ingested by a human or an animal by being directly applied to the mouth or in an admixture to food or drinking water. It may also include cosmetic products (in the form of solutions, suspensions, gels or pastes) for use on the hands, skin, face or hair of an individual. It may include medicines for human and veterinary use, and in the latter category, examples of compositions ideally suited to the packaging of the invention include compositions for pest prevention or treatment of infestations in domestic animals, in particular dogs and cats, in the form of a ready-to-use, spot-on solution. This is usually applied topically over a surface area of less than 5 cm2 between the shoulders at 1 or 2 spots. Such compositions may comprise at least one active ingredient advantageously selected from fipronil, pyriproxyfen, imidacloprid, permethrin, nitenpyram. In the preferred case where the active ingredient is Fipronil, the composition may also contain another pest-control agent which broadens Fipronil's spectrum of activity, such as an acaricide, for example amitraz, permethrin or cymiazole, an insect growth-inhibitor or IGR against flees or ticks, such as pyriproxyfen or ethoxazole, an avermectin or derivatives thereof, acting against endoparasites, such as ivermectin, abamectin, doramectin, moxydectin or milbemycin. The compositions according to this invention are generally prepared simply by dissolving the active insecticide ingredients in the solvent system according to techniques known to those skilled in the art.

Figure 9:
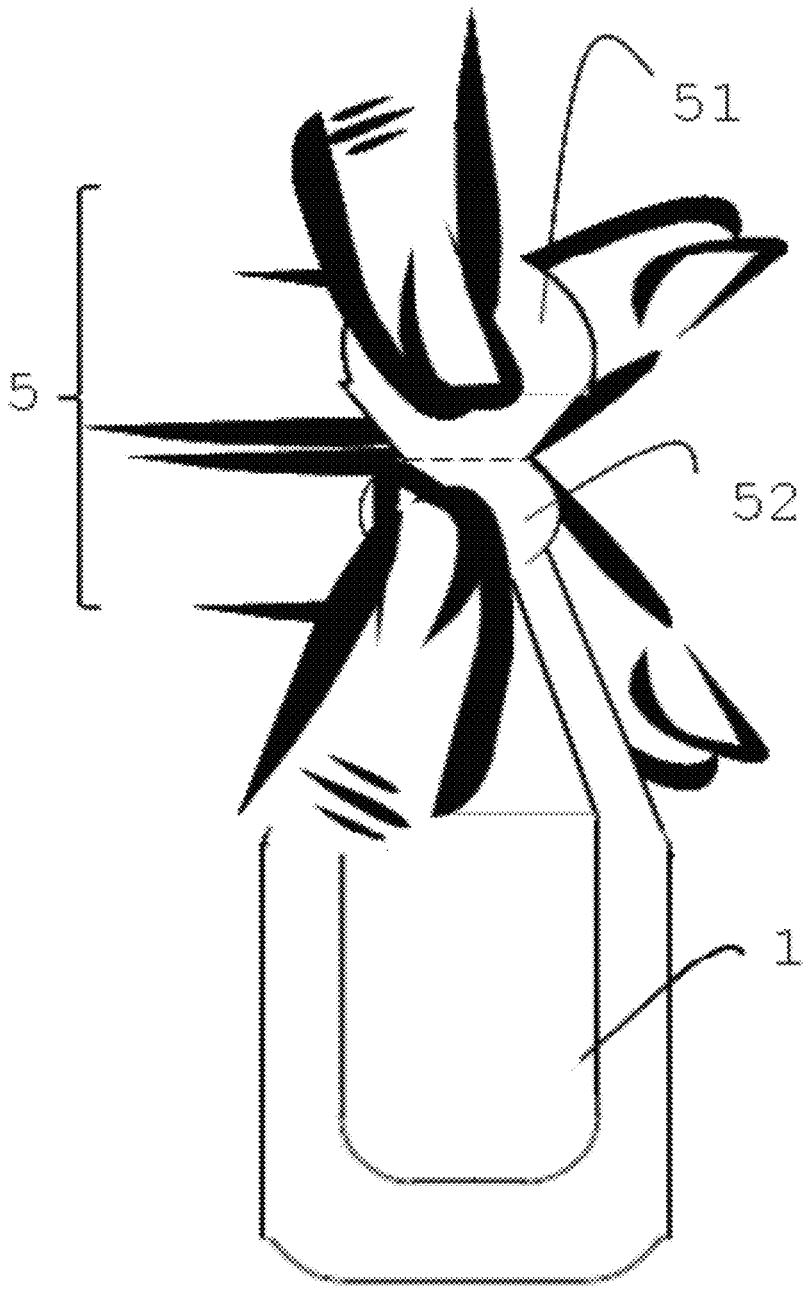
FIG. 9 shows, in a schematic view, the opening of a packaging, according to the invention.
Figure 10:
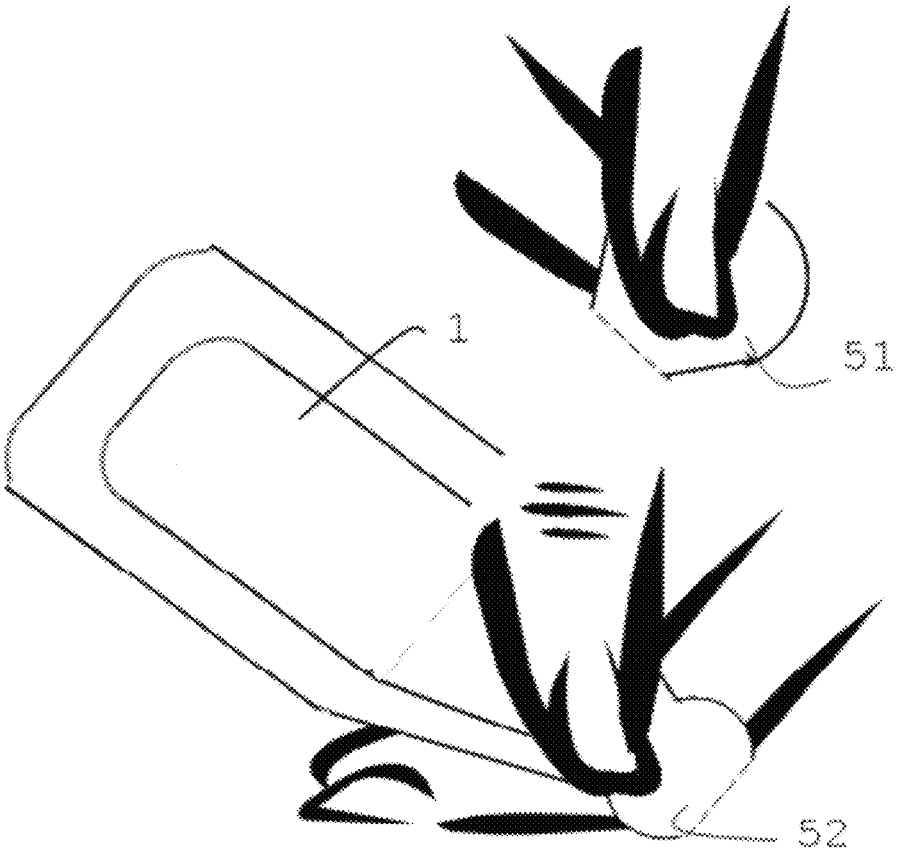
FIG. 10 shows, in a schematic view, a tipped packaging after opening, according to the invention.
Figure 11:
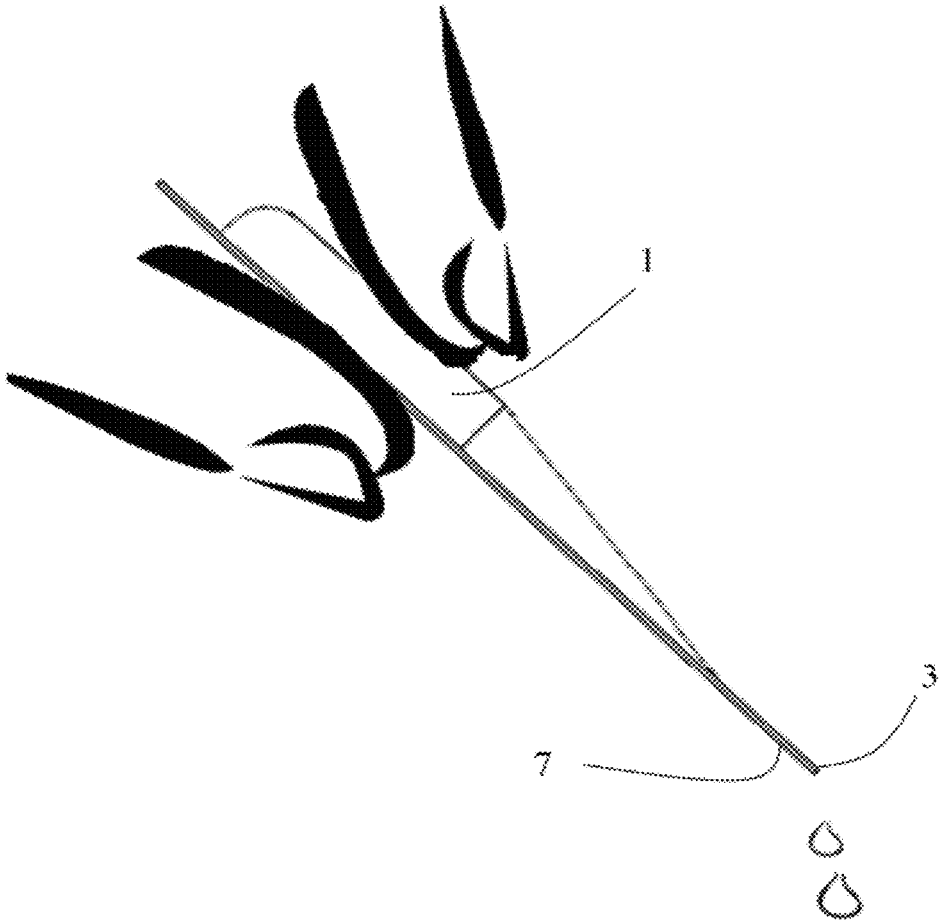
FIG. 11 shows, in a schematic view, a side view of an open packaging when in use, according to the invention.

FIGS. 9, 10 and 11 schematically illustrate the packaging when in use. More specifically, FIG. 9 illustrates the manner in which the fingers are positioned by the user to best tear the packaging open in the breakage area 6.

FIG. 10 shows the packaging when open. As can be seen in this figure, the packaging does not allow the contents to escape by mere gravity when the user holds it. Thus, the contents remain within the storage space 1. Indeed, the system, with its escape path 7, allows the packaging to be held or simply laid down, without having to pay attention to the opening since the open system does not leak. The discharge of the contents out of the packaging is therefore under the control of the user. The liquid or paste contained within the storage space is discharged under pressure applied by the user to the storage space. This pressure drives out the paste or liquid along the escape path 7 whose flexible portion deforms and allows the contents to escape under the effect of pressure applied by the user to the storage space 1 (FIG. 11).

Furthermore, according to a preferred embodiment of the present invention, once the breakage area has been torn or broken, the gripping lug 51 is fully detached from the packaging. Access to the site of use or application of the liquid or paste is thus simplified because this gripping lug 51 does not hinder access to the remaining packaging at the site where it is used, as may be the case with other prior art packaging items.

As shown in FIG. 11, which shows a side view of the packaging when the user presses the storage space 1, its contents flow along the escape path 7 only when the user presses the deformable shell forming the storage space 1.

Figure 5:
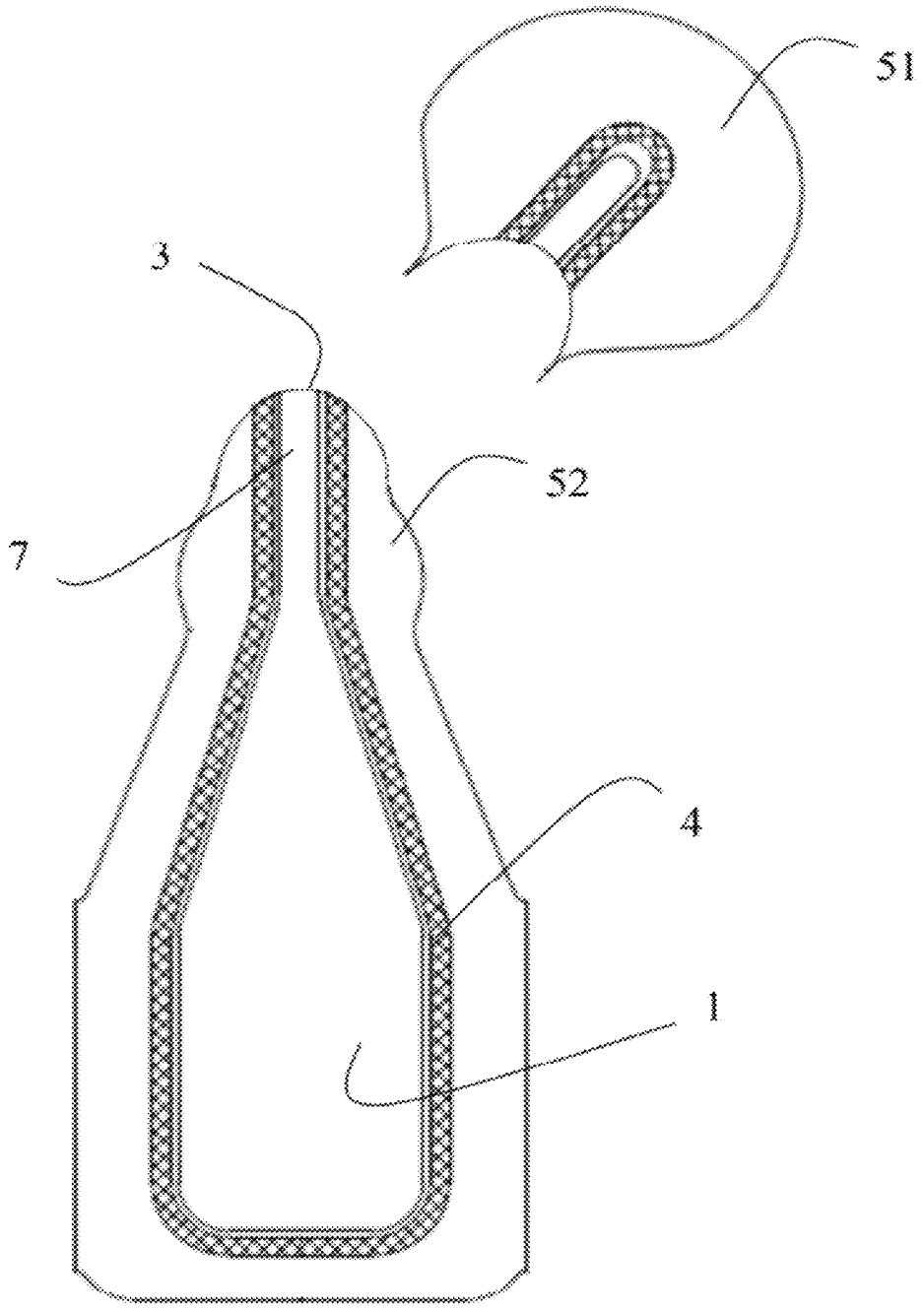

Furthermore, according to a preferred embodiment of the invention, after opening, when administering the contents on the site of use, for example on the skin, between the hairs of an animal, or on the mucosa, the open packaging should be atraumatic. The system with its escape path 7, which is opened by tearing or breaking a reduced area between two gripping lugs, has no sharp edge near the applicator 3 (FIG. 5). However, it was observed that even in the presence of sharp edges near the applicator 3, the discharge under pressure of the composition contained in the packaging allows the application sites to be reached without the need to place said application site directly into contact with the applicator 3. This is the case, in particular, when administering a liquid pest-control product in the spot-on form onto the skin of a dog or cat: the output pressure of the liquid allows the product to reach the animal's skin through its hair, which can form a barrier up to the skin. Thus, the skin is not scratched or injured.

In summary, the packaging according to the invention is, in a preferred embodiment, a thermoformed small-size plastic packaging, for example less than 10 cm in height, 5 cm in width and 2 cm in thickness, having:

- a gripping area comprising at least one lug and a pre-cut area;
- a storage space which is deformable under finger pressure, intended to contain a more or less viscous liquid; and
- an escape path for said liquid extending at least from said storage area to said pre-cut area, and such that, when said packaging is opened, in the pre-cut area, the liquid contained in the storage space can flow along said escape path to be expelled after said storage space has been deformed under the action of pressure applied by a user's fingers. The size of the escape path, in particular its diameter, is calculated so that the liquid cannot be expelled without the storage space being deformed under the action of pressure.

The invention also relates to a food, cosmetic, pharmaceutical or veterinary composition, in a packaging such as described above.

According to the invention such compositions can also be combined into a single package. This package may also contain a user manual specifying whether or not said compositions, whether identical or different, are to be used together, or at regular intervals.

Thus, preferably, the invention also relates to a package comprising four packaging items, which contain compositions intended for veterinary use. The first two packaging items are to be used together and include two different compositions. The third and fourth packaging items comprise one of the two first compositions and are used within a time period of one to four months each, preferably one month. The number of packaging items to be used, their frequency of use and the nature of the active ingredients included in the formulations will depend on the pathology to be treated and the prescribed dosage.

Of course, the invention is not limited to the embodiments described and illustrated in the accompanying drawings, and those skilled in the art will be able, through routine operations, to implement additional embodiments not explicitly described without departing from the scope of the present invention.

Example 1

A pipette for veterinary use is made according to the diagram shown in FIG. 1. The bottom complex is made of Polybar™, which consists of a film of cyclo-olefin copolymer (COC) coextruded between two polypropylene (PP) layers, laminated to a film of Barex™ The sealing complex consists of a PET/aluminum/Barex™ complex. Packaging assembly is achieved by thermo-welding of the bottom complex to the sealing complex. A breakage line is formed by a blade in the breakage area 6. The contents consist of a solution having the following formula:

| Components | Amount |
|---|---|
| Fipronil | 10.0 g |
| Benzyl alcohol | 30.0 g |
| Butylhydroxyanisole | 0.02 g |
| Butylhydroxytoluene | 0.01 g |
| Diethylene glycol monoethyl ether | q.s. 100 ml |

The rated volume of each pipette is 0.5 ml, 0.67 ml, 1.34 ml, 2.68 ml and 4.02 ml. Each pipette has the same cut shape, with only the depth of the storage space being adapted to its capacity.

The opening of the pipettes is achieved by holding the pipette with the "bottom complex" facing the user (protruding storage space). The lug 52 is firmly held while lug 51 is pushed until breakage of the bottom complex. It is then observed that the pressure applied to the storage space still does not allow the product to be expelled. It is necessary to entirely fold the lug 51 towards the user such that it becomes detached and releases the applicator 3. The product can then be discharged by the pressure applied to the storage space 1. It is also observed that the liquid flows as a continuous and powerful jet, thus offering the advantage of allowing deep hidden areas to be reached down to the skin, within the fur of an animal during topical application.

In terms of stability, at room temperature, each pipette confers excellent stability to the active ingredient contained in the formula, in compliance with drug regulations.

Conclusion: It is observed that until the applicator has been released, the product cannot be discharged. This contributes to the high safety of use of this packaging. Moreover, the pressure needed to expel the liquid jet has the advantage of allowing the areas to be treated to be reached without any contact being required between said area to be treated and the applicator.

Tests:

Tests have been conducted to demonstrate the benefits of a pipette according to the invention with respect to prior art pipettes that include a thereto-formed nozzle near the applicator.

Test 1:

These tests were initially focused on the performance of the pipettes during or after opening in situations that may occur during use. Number of pipettes tested: 5 of each model.

| | Pipette according to the invention Distributed weight 1 g | Pipette with a thermoformed nozzle Distributed weight 0.6 g |
|---|---|---|
| Fall from the height of a table (75 cm) | Loss of product of the order of 0.01 g on average, or 1% of the distributed product | Loss of product of the order of 0.07 g on average, or 11.6% of the distributed product |
| Opening upside down and shaking (three lateral movements performed in 3 secs.) | No leakage, no drop | Appearance of a drop on opening and then several drops escaping from the pipette when shaking |
| Presence of product on the fingers on opening | No | Possible splashing on opening, observed in particular when liquid product is present in the nozzle |

| | Pipette according to the invention Distributed weight 4 g | Pipette with a thermoformed nozzle Distributed weight 4.2 g |
|---|---|---|
| Fall from the height of a table (75 cm) | Loss of product of the order of 0.03 g on average, or 0.75% of the distributed product | Loss of product of the order of 0.2 g on average, or 4.76% of distributed product |
| Opening upside down and shaking (three lateral movements performed in 3 secs.) | No drop | Appearance of a drop on opening and then several drops escaping the pipette when shaking |
| Presence of product on the fingers on opening | No | Frequent splashing on opening |

In conclusion, the pipette according to the invention prevents the leakage of product during opening and once it has been opened (in case the pipette is dropped or mishandled).

Test 2

During these tests, which were performed on a sample of 10 users aged between 25 and 59, the percentage of recovered product when pressing the storage space was studied. In addition, each user provided a qualitative comment on the pipette and its use.

| Pipettes according to the invention | Distributed weight (g) | Retrievable weight (g) | Recovery percentage (%) |
|---|---|---|---|
| P1 | 1 | 0.951 | 95.1 |
| P2 | 1 | 0.913 | 91.3 |
| P3 | 1 | 0.923 | 92.3 |
| P4 | 1 | 0.945 | 94.5 |
| P5 | 1 | 0.937 | 93.7 |
| P6 | 1 | 0.950 | 95 |
| P7 | 1 | 0.950 | 95 |
| P8 | 1 | 0.922 | 92.2 |
| P9 | 1 | 0.933 | 93.3 |
| P10 | 1 | 0.949 | 94.9 |

These results show excellent product delivery when the storage space is pressed, with a recovery rate in the range between 91.3 to 95%.

Conclusions of the Tests:

Delivery of the product contained in the pipettes according to the invention is performed under the exclusive control of the user. The pipette according to the invention provides an excellent safety level, as perceived by the users, both for the user and also for the environment. Additional tests performed with children below the age of 5 have confirmed the excellent safety of the pipettes according to the invention in terms of prevention of opening by children. Moreover, the same pipettes according to the invention presented to elderly people were easily opened and used.

The invention claimed is:

1. A non-resealable thermoformed packaging for delivering a liquid or pasty substance, said packaging comprising an assembly of (i) a thermoformed bottom complex made in a rigid but deformable film, and (ii) a sealing complex made in a flexible film, wherein the packaging comprises:

- a storage space that can be deformed by means of pressure applied by a user, said storage space containing said liquid or pasty substance;
- a breakage area having a transverse weakened line for releasing an applicator in order to eject the liquid or pasty substance from said packaging; and
- a conduit extending from the storage space to the applicator for passage of said liquid or pasty substance from said storage space to an orifice on said applicator, said orifice being naturally open after the applicator has been released, a gripping area, wherein the gripping area extends from the storage space to the breakage area and includes an escape path for said liquid or pasty substance, wherein the escape path is formed by an unsealed, narrow contact area between the bottom complex and the sealing complex in the conduit, said contact area extending between lateral edges of the escape path, the bottom complex being sealingly assembled to the sealing complex at the lateral edges of the escape path, the escape path being naturally closed in the absence of pressure applied by the user to block the discharge of said liquid or pasty substance after the applicator has been released, wherein an upper portion of the packaging contains reinforcements arranged on both lateral sides of the escape path, wherein the packaging has a pre-opening configuration and a post-opening configuration, wherein, in the pre-opening configuration, the applicator has not been released and the volume formed by the storage space and the conduit is surrounded by a sealed area, and wherein, in the post-opening configuration, the applicator has been released and the orifice is naturally open, so that (i) the unsealed, narrow contact area of the escape path prevents liquid or pasty substance from escaping the storage area through the conduit in the absence of pressure applied to the storage space, (ii) the escape path enables discharge of the liquid or pasty substance from the storage space through the conduit when pressure is applied by the user to the storage space, wherein the pressure is propagated to the escape path and causes a deformation that leads to a disappearance of close contact in the unsealed, narrow contact area between the bottom complex and the sealing complex, and (iii) the reinforcements improve a rigidity of the upper portion of the packaging at the escape path.

2. The packaging according to claim 1, wherein the applicator has no sharp edges.

3. The packaging according to claim 1, wherein the weakened line is reinforced by a pealable label.

4. The packaging according to claim 1, wherein the packaging is assembled by thermo-welding between said bottom complex which is embossed by thermoforming near to the storage space, and said sealing complex.

5. The packaging according to claim 4, wherein the rigid film of said thermoformed bottom complex is made of a material selected from polypropylene (PP), polyvinyl chloride (PVC), polyvinylidene chloride, cyclo-olefin copolymer (COC), polychlorotrifluoro ethylene (PCTFE), or derivatives thereof, alone or in admixture, and the flexible film of the sealing complex is made of a material selected from polyethylene terephthalate (PET), polyamide, aluminum or polyacrilonitrile, or derivatives thereof, alone or in admixture.

6. The packaging according to claim 1, wherein the storage space comprises as the liquid or pasty substance a composition comprising at least one active ingredient selected from fipronil, pyriproxyfen, imidacloprid, permethrin, nitenpyram, alone or in admixture.

7. A food, cosmetic, pharmaceutical or veterinary composition, formulated in a packaging according to claim 1.

8. A method for producing a packaging according to claim 1 comprising:

a step of sealing a thermoformed rigid complex made in a rigid but deformable film and a flexible portion made in a flexible film, to form a storage space, a breakage area having a transverse weakened line for releasing an applicator, a conduit extending from the storage space to an orifice on the applicator for passage of a liquid or pasty substance from said storage space to said applicator, and a gripping area, wherein the gripping area extends from the storage space to the breakage area and includes an escape path of the liquid or pasty substance, by gluing, thermo-sealing, or welding of the bottom complex with the sealing complex, and a cutting step to achieve a final form of the packaging, wherein the orifice is naturally open after the applicator has been released, wherein the escape path is formed by an unsealed, narrow contact area between the bottom complex and the sealing complex in the conduit, said contact area extending between lateral edges of the escape path, by thermo-sealing or gluing the bottom complex to the sealing complex at the lateral edges of the escape path, the escape path being naturally closed in the absence of pressure applied by the user to block the discharge of said liquid or pasty substance after the applicator has been released, and wherein an upper portion of the packaging contains reinforcements arranged on both lateral sides of the escape path, wherein the packaging has a pre-opening configuration and a post-opening configuration, wherein, in the pre-opening configuration, the applicator has not been released and the volume formed by the storage space and the conduit is surrounded by a sealed area, and wherein, in the post-opening configuration, the applicator has been released and the orifice is naturally open, so that (i) the unsealed, narrow contact area of the escape path prevents liquid or pasty substance from escaping the storage area through the conduit in the absence of pressure applied to the storage space, (ii) the escape path enables discharge of the liquid or pasty substance from the storage space through the conduit when pressure is applied by the user to the storage space, wherein the pressure is propagated to the escape path and causes a deformation that leads to a disappearance of close contact in the unsealed, narrow contact area between the bottom complex and the sealing complex, and (iii) the reinforcements improve a rigidity of the upper portion of the packaging at the escape path.

9. Method according to claim 8, wherein the step of sealing a thermoformed rigid portion and a flexible portion is done by thermo-sealing of the bottom complex with the sealing complex.

10. Method according to claim 8, wherein the rigid film of said thermoformed bottom complex is made of a material selected from polypropylene (PP), polyvinyl chloride (PVC), polyvinylidene chloride, a cyclo-olefin copolymer (COC), polychlorotrifluoro ethylene (PCTFE), or derivatives thereof, alone or in admixture; and the flexible film forming the sealing complex is made of a material selected from polyethylene terephthalate (PET), polyamide, aluminum or polyacrylonitrile or derivatives thereof, alone or in admixture.

11. The method according to claim 8, wherein the weakened line forms a breakage line having a convex shape extending from one lateral end of the breakage area to an opposite lateral end of the breakage area.

12. The method according to claim 8, wherein a naturally open portion of the conduit extends from the escape path to the orifice on the applicator after the applicator has been released.

13. The method according to claim 8, wherein the conduit is a thermoformed conduit formed in the rigid film and covered by the flexible film.

14. The method according to claim 13, wherein the thermoformed conduit has a naturally open portion between the escape path and the orifice on the applicator.

15. The method according to claim 8, wherein the weakened line is formed in a narrowing between the gripping area and an upper gripping area in an upper end portion of the packaging in the pre-opening configuration of the packaging.

16. The packaging according to claim 1, wherein a naturally open portion of the conduit extends from the escape path to the orifice on the applicator after the applicator has been released.

17. The packaging according to claim 1, wherein the weakened line forms a breakage line having a convex shape extending from one lateral end of the breakage area to an opposite lateral end of the breakage area.

18. The packaging according to claim 1, wherein the conduit is a thermoformed conduit formed in the rigid film and covered by the flexible film.

19. The packaging according to claim 18, wherein the thermoformed conduit has a naturally open portion between the escape path and the orifice on the applicator.

20. The packaging according to claim 1, wherein the escape path is flat.

21. The packaging according to claim 1, wherein the escape path is opened by deformation of the flexible film when pressure is applied.

22. The packaging according to claim 1, wherein the weakened line is formed in a narrowing between the gripping area and an upper gripping area in an upper end portion of the packaging in the pre-opening configuration of the packaging.

* * * * *